US007234981B2

(12) United States Patent
Eppe et al.

(10) Patent No.: US 7,234,981 B2
(45) Date of Patent: Jun. 26, 2007

(54) SPRING FORCE TERMINAL

(75) Inventors: Klaus-Peter Eppe, Waldbrunn (DE); Maarten Le Grand, Heidelberg (DE); Alexander Orban, Weinheim (DE)

(73) Assignee: ABB Patent GmbH, Ladenburg (DE)

( * ) Notice: Subject to any disclaimer, the term of this patent is extended or adjusted under 35 U.S.C. 154(b) by 0 days.

(21) Appl. No.: 11/061,533

(22) Filed: Feb. 18, 2005

(65) Prior Publication Data

US 2005/0245143 A1 Nov. 3, 2005

(30) Foreign Application Priority Data

Feb. 19, 2004 (DE) ..... 10 2004 008 447

(51) Int. Cl.
*H01R 4/48* (2006.01)

(52) U.S. Cl. ..... 439/834

(58) Field of Classification Search ..... 439/846, 439/834, 839, 828

See application file for complete search history.

(56) References Cited

U.S. PATENT DOCUMENTS 1,688,182 A * 10/1928 Fitzgerald ..... 439/828
6,004,168 A * 12/1999 Fuchs et al. ..... 439/835

FOREIGN PATENT DOCUMENTS

DE 198 17 927 C1 10/1999
DE 199 34 550 A1 2/2001
DE 202 06 763 U1 10/2002
DE 202 10 105 U1 11/2002
DE 102 61 536 A1 7/2004

OTHER PUBLICATIONS

Cited in the attached German Search Report (with English translation of category of cited documents) dated Nov. 24, 2004).

* cited by examiner

*Primary Examiner*—Briggitte R. Hammond
(74) *Attorney, Agent, or Firm*—Buchanan Ingersoll & Rooney PC

(57) ABSTRACT

The invention describes a spring force terminal (1) for connecting electrical conductors (128), having a contact frame (3, 125), in which an electrical conductor (128) can be clamped against the contact frame (3, 125) by means of a clamping spring (7, 121) extending in the form of an arc over the contact frame (3, 125), and which is characterized in that the contact frame (3, 125) has two or more plug openings (9, 11, 124) and a retaining opening (13, 133), in that the clamping spring (7, 121) is held at a first free end in the retaining opening (13, 133) on the contact frame (3, 125), in that, at its second free end, the clamping spring (7, 121) is divided into a number of finger-like projections (23, 25, 122) which corresponds to the number of plug openings (9, 11, 124) by means of one or more slot-like cutouts (17), and in that each of the projections (23, 25, 122) is passed through in each case one of the plug openings (9, 11, 124), and a conductor (128) can be clamped tightly in each of the plug openings (9, 11, 124) by in each case one of the projections (23, 25, 122).

14 Claims, 2 Drawing Sheets

SPRING FORCE TERMINAL

BACKGROUND OF THE INVENTION

1. Field of the Invention

The invention relates to a spring force terminal for connecting electrical conductors, having a contact frame, in which an electrical conductor can be clamped against the contact frame by means of a clamping spring extending in the form of an arc over the contact frame, in accordance with the preamble of claim 1, and to a service switching device having a spring force terminal.

2. Description of Related Art

Spring force terminals of the generic type are used, for example, as a connecting apparatus for electrical incoming and outgoing conductors in service switching devices in order to produce an electrical and mechanical connection between the conductors and the service switching device without the aid of a tool. Service switching devices may be, for example, circuit breakers having thermal and magnetic releases for ensuring overload and short-circuit protection in downstream circuits.

DE 198 17 927 C1 discloses such a generic spring force terminal. There, an electrical conductor is pushed into a rectangular cutout in a busbar, which has been inserted in a terminal housing, by means of a leaf spring against the upper edge of the cutout.

However, it is not possible for contact to be made in a simple and reliable manner with two or more conductors with such a spring force terminal.

SUMMARY OF THE INVENTION

It is therefore the object of the present invention to provide a spring force terminal and a service switching device with which the connection of one or more conductors is simplified and made more reliable.

The object is achieved with respect to the spring force terminal by the characterizing features of Claim 1 and with regard to the service switching device by the characterizing features of Claim 15.

According to the invention, the contact frame thus has two or more plug openings and a retaining opening. The clamping spring is held at a first free end in the retaining opening on the contact frame. At its second free end, it is divided into a number of finger-like projections which corresponds to the number of plug openings by means of one or more slot-like cutouts such that each of the projections is passed through in each case one of the plug openings, and a conductor can be clamped tightly in each of the plug openings by in each case one of the projections.

The advantage of the spring force terminal according to the invention is that in each case a dedicated plug opening is provided for a conductor to be connected, and a conductor can be clamped tightly in said plug opening by means of a projection, associated with this plug opening, of the clamping spring, irrespective of whether there are also conductors in that or in the other plug openings. The clamping spring is a single component which is divided up into two or more functionally identical but physically separated spring elements, which also function independently of one another, by means of the slot-like cutouts. For example, in the case of two plug openings, a conductor can be clamped tightly in one of the two plug openings but not in the other. Subsequently, one second conductor can also be inserted in the second plug opening and/or the first conductor can be removed again from the first plug opening.

One further advantage of the spring force terminal according to the invention is the simple way in which the clamping spring can be mounted. Said clamping spring can be inserted in the retaining opening with its free end, which is matched to the retaining opening, and is held on the contact frame.

In one particularly advantageous variant of the spring force terminal according to the invention, the contact frame has two plug openings and a retaining opening, and the clamping spring is held at a first free end in the retaining opening on the contact frame, and, at its second free end, is divided into two finger-like projections by means of a slot-like cutout such that each of the two projections is passed through in each case one of the plug openings, and a conductor can be clamped tightly in each of the two plug openings by in each case one of the projections. This embodiment is particularly space-saving and covers a large proportion of service switching device applications.

The contact frame is divided in a particularly advantageous manner into plug openings and a retaining opening by means of webs. One of the webs may in this case at the same time be a means for protecting the spring projections from being overextended. This means that this web limits the maximum spring travel such that the clamping spring cannot be deformed beyond a maximum permissible range. This ensures that the clamping spring always has a constant clamping force action.

Two webs may in this case be arranged in the contact frame as the transverse web and the longitudinal web in the form of a T so as to produce, as a result, two plug openings and a retaining opening. The retaining opening may then be arranged, for example, above the transverse web, and the plug openings may be arranged below the transverse web and on both sides of the longitudinal web in the contact frame. In this case, the transverse web acts as a means for protecting the spring projections of the clamping spring from being overextended.

In one particularly advantageous embodiment, the clamping spring is bent in the form of a U.

In an even more particularly advantageous embodiment, the clamping spring may also be provided with a slot in the longitudinal direction on a subsection starting from the branch of the spring projections in the direction of the first free end of said clamping spring. The advantage of such an additional slot is the fact that further means are provided for separating the individual spring projections from one another.

It is further advantageous if the contact frame has a rectangular outer contour, and also the plug openings and the retaining opening are rectangular.

One free end of the contact frame may in a very advantageous manner be in the form of a connecting part for fixing an electrical outgoing conductor and may be oriented in the insertion direction of the conductor. The outgoing conductor, which, for example when using the spring force terminal according to the invention as the connecting terminal in a service switching device, is the conductor of the inner main current path, can be, for example, welded to this connecting part. The orientation of the connecting part in the insertion direction of the conductor to be inserted brings about a further space saving when installing the spring force terminal according to the invention in a service switching device.

An adjustment contact part, for example in the form of a metal sheet bent in the form of a U, may also be integrally formed on that end of the contact part which lies opposite the connecting part. Such an adjustment contact part is required when automatic adjustment measures are carried out in the course of the production of service switching devices with a thermal release (bimetallic release) for making contact with the thermal release. With the spring force terminal according to the invention, the adjustment contact part may advantageously be produced in an integrated unit with the contact body.

Finally, in a further, advantageous refinement of a spring force terminal according to the invention, the adjustment contact part forms such an angle with each of the spring projections that, as a result, a funnel function is realized in order to make it easier to insert the conductor end pieces in the plug openings.

A service switching device according to the invention having at least one spring force terminal according to the invention is characterized in that the terminal housing is integrated in the switching device housing. This may advantageously take place, for example, such that the spring force terminal is held in the region of the terminal accommodating area of the service switching device on the insides of the housing shells. The advantage of such a service switching device according to the invention having a spring force terminal according to the invention lies in its cost-effective manufacture. The spring force terminal itself does not require a dedicated insulating housing, as a result of which the costs per item for this component are reduced. It can be inserted in the terminal accommodating area of the housing shells of the service switching device by machine as a prefabricated assembly, if possible with the outgoing conductor already welded on, during the course of automated manufacture of the service switching device. For this purpose, the housing shells of the service switching device have corresponding retaining apparatuses, generally grooves and protrusions, which are matched to the geometry of the spring force terminal.

Further, advantageous refinements and improvements of the invention and further advantages are described in the further subclaims.

DESCRIPTION OF THE DRAWINGS

The invention and further, advantageous refinements and improvements of the invention will be explained and described in more detail with reference to the drawings, in which one exemplary embodiment of the invention is illustrated and in which.

DETAILED DESCRIPTION

Figure 1:
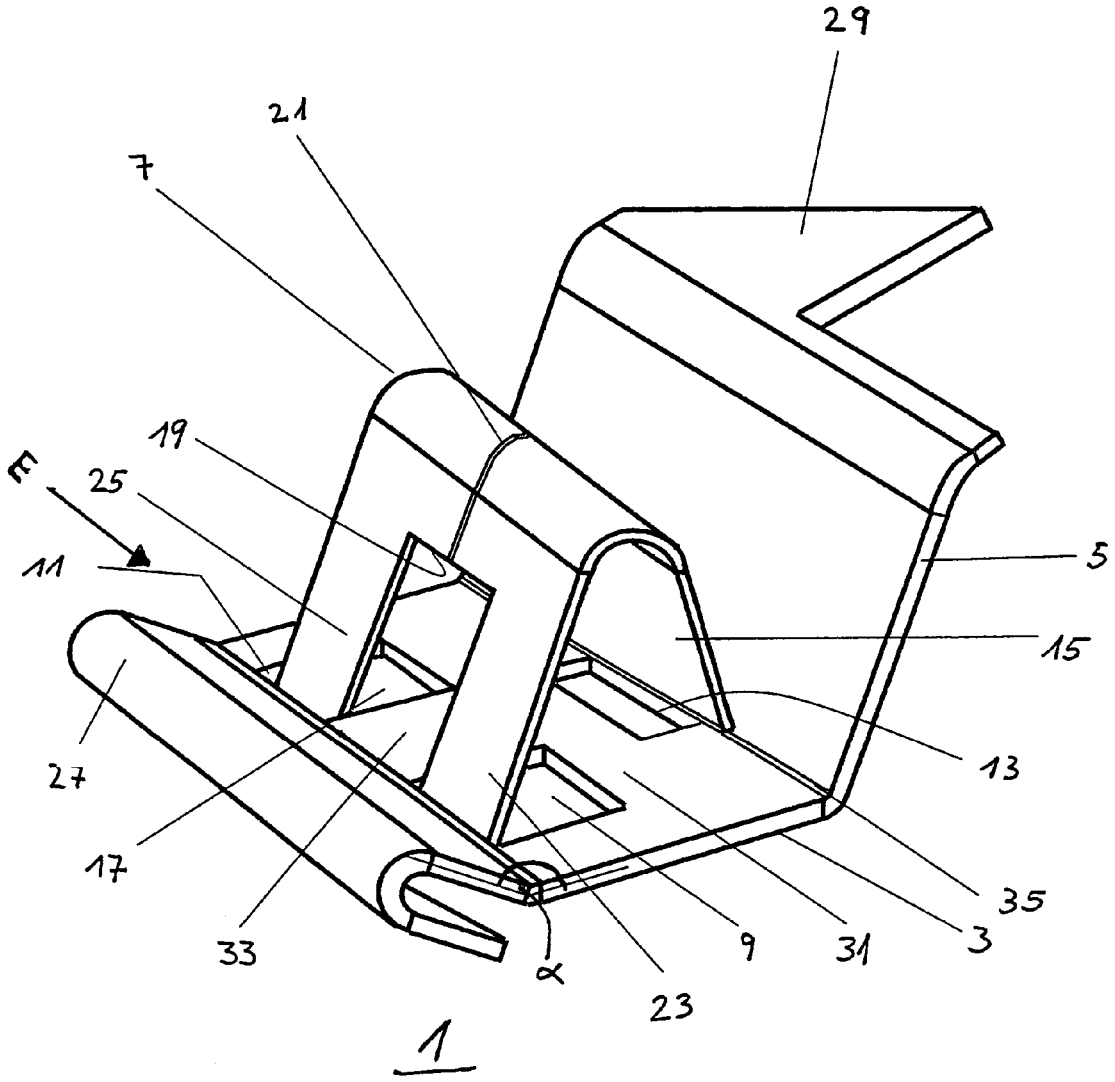
FIG. 1 shows a spring force terminal according to the invention.

FIG. 1 shows a spring force terminal 1 having a rectangular contact frame 3. One free end 5 of the contact frame is in the form of a likewise rectangular connecting part 5 and is bent back in the direction of the clamping spring 7. A rectangular metal contact sheet 29, which extends over approximately half the width of the connecting part 5, is integrally formed on the free end of the connecting part 5. An outgoing conductor can be fitted, for example welded, to the metal contact sheet 29 when the spring force terminal is installed in a service switching device.

The contact frame is divided into two plug openings 9, 11 and a retaining opening 13 by means of two webs arranged in the form of a T, a transverse web 31 and a longitudinal web 33.

The insertion direction of the conductors into the plug openings is indicated by the arrow E. The clamping spring 7 which is bent in the form of a U spans the contact frame in the opposite direction to the insertion direction E.

The clamping spring 7 is pushed with its first free end 15 into the retaining opening 13 against the retaining edge 35 of said retaining opening 13 and is thus held on the contact frame 3. At its other free end, the clamping spring 7 is divided into two finger-like spring projections 23, 25, which are passed, starting from a branch edge 19, through in each case one of the plug openings 9, 11, by means of a slot-like cutout 17.

The clamping spring 7 is also provided with a longitudinal slot 21 at the subsection, which extends from the branch edge 19 in the direction of the retaining edge 35, in a subregion, starting at the branch edge 19.

The slot-like cutout 17 and the longitudinal slot 21 mean that it is possible for the spring projections 23, 25 of the clamping spring 7 to be bent independently of one another without them influencing one another. This makes it possible for a conductor to be inserted in each of the two plug openings 9, 11 and clamped tightly therein by the spring projection 23, 25 associated with this plug opening, irrespective of whether or not a conductor has likewise been inserted in the other plug opening 11, 9. Whether a conductor has been inserted in one or in both of the plug openings 9, 11 has largely no influence on the clamping force of the two spring projections 23, 25.

Without a conductor inserted, as illustrated in FIG. 1, the spring projections 23, 25 bear against a contact edge 37 of the plug openings 9, 11 which lies opposite the transverse web 31.

Adjacent to the contact edge 37, a free end of a limb of a U-shaped metal sheet 27, whose width corresponds to the width of the contact frame 3, is integrally formed on the contact frame 3. The integrally formed limb forms an obtuse angle $\alpha$ with the contact frame 3. An acute angle is thus formed between the metal sheet 27 and the spring projections 23, 25 such that, as a result, a funnel-shaped insertion guidance is provided for conductors to be inserted in the plug openings 9, 11. The function of the metal sheet 27 is that of an adjustment contact part. If the spring force terminal 1 is installed in a service switching device, the adjustment contact part realized by the metal sheet 27 serves the purpose of providing an electrical contact for the automated thermal adjustment of the thermal release of the service switching device.

The insertion of a connecting conductor is made easier by the funnel-shaped opening, formed from the spring projections 23, 25 and the metal sheet 27. A connecting conductor piece, which is inserted in an insertion opening 9, 11 against the spring projection 23, 25, pushes the free end of the spring projection 23, 25 associated with this insertion opening in the direction of the transverse web 31. Owing to the resetting spring force, the connecting conductor piece is then pushed by the free end of the corresponding spring projection 23, 25 against the contact edge 37 such that mechanical and electrical contact is made.

The transverse web 31 in this case acts as a means for protecting the spring projections 23, 25 from being overloaded. This is because it is not possible for the spring projections 23, 25 to be pushed any further than up to the transverse web 31. This makes it possible to reliably prevent the spring projections 23, 25 from being deformed beyond their elastic range and thus their spring properties from being impaired by continuous deformation.

Figure 2:
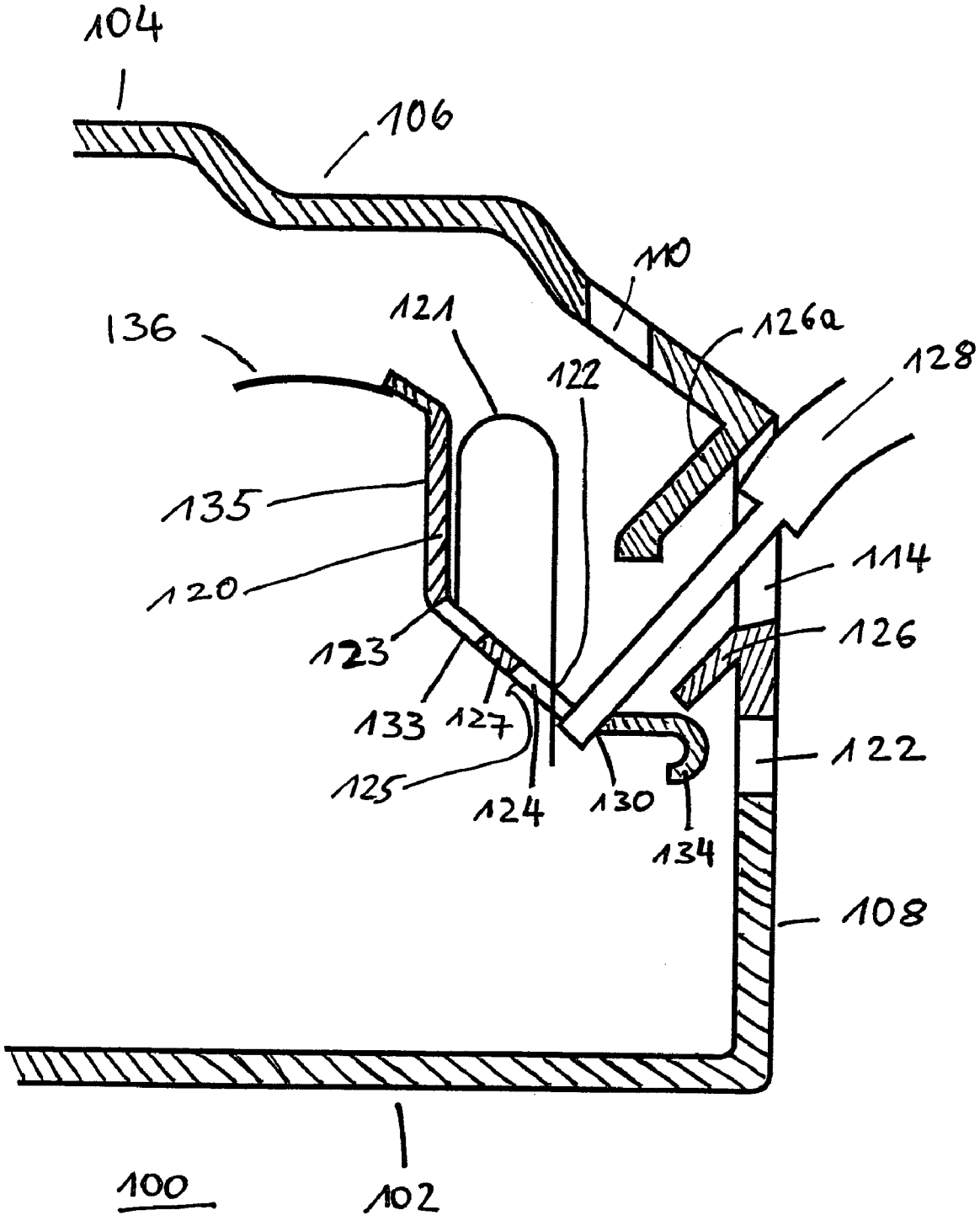
FIG. 2 shows a schematic of a spring force terminal according to the invention when installed in a service switching device according to the invention.

FIG. 2 shows a schematic of a spring force terminal 120 according to the invention when installed in the terminal accommodating area of a service switching device 100. The service switching device 100 is illustrated schematically as a plan view of an open insulating housing shell. The front face 104, the rear face 106, the rear narrow side 108 and the fixing side 102 are shown. Other essential functional modules of the service switching device are not illustrated in FIG. 2 for reasons of clarity.

The terminal accommodating area is formed in the housing shells in the region between the rear narrow side 108, the fixing side 102 and the rear face 106. The spring force terminal 120 is fixed there in the position shown in FIG. 2 by retaining apparatuses (not shown here). Such retaining apparatuses are generally grooves or protrusions integrally formed on the inside of the housing shells.

A conductor opening 114 is formed by means of a cutout in the rear housing narrow side 108. Guide webs 126, 126*a* protruding into the housing interior form an insertion funnel, which protrudes out of the conductor opening 114 into the housing interior and through which a connecting conductor 128 is passed when its connecting end, from which the insulation has been stripped, is inserted in the direction of the plug opening 124 in the contact frame 125 of the spring force terminal 120.

In addition, on the spring force terminal 120 the connecting end of the connecting conductor 128 is also passed through the insertion funnel formed from the spring projection 122, which protrudes into the plug opening 124, and from the adjustment contact part 134, which is integrally formed on the contact frame 125, into the plug opening 124.

The connecting end, from which the insulation has been stripped, of the connecting conductor 128 is pushed in a resilient manner against the contact edge 130 of the plug opening 124 in the contact frame 125 by the free end of the clamping spring 121, which is held at the retaining edge 132 in the retaining opening 133 and is bent in the form of a U over the contact frame 125, such that, as a result, the electrical and mechanical contact is brought about between the connecting conductor and the spring force terminal.

The clamping spring 121 is prevented from being overextended by the transverse web 127 in the contact frame 125, which divides the contact frame into the retaining opening 133 and the plug openings 124, of which in this case only one can be seen in the sectional illustration.

At the same height as the adjustment contact part 134, a calibration opening 112 is cut out in the rear housing narrow side 108, and a calibration contact pin can be brought into contact with the adjustment contact part 134 through said calibration opening 112 during automated calibration. When the service switching device has been completely calibrated, the calibration opening 112 is then closed by a lid.

At the same height as the clamping spring 121, a release opening 110 is cut out in the rear housing face 106 and is dimensioned such that a conventional screwdriver passes through. In order to release the clamping connection, the clamping spring 121 is then pushed away from the connecting conductor by a screwdriver passed through the release opening 110 such that the connecting conductor 128 can be removed. In this case, the transverse web 127 again also prevents the clamping spring 121 from being overextended.

An outgoing conductor 136 is welded to the connecting part 135, which is bent at an obtuse angle in the direction of the inserted connecting conductor 128, of the contact frame 125.

The invention claimed is:

1. A spring force terminal for connecting electrical conductors, having a contact frame, in which an electrical conductor can be clamped against the contact frame by means of a clamping spring extending in the form of an arc over the contact frame, wherein the contact frame has two or more plug openings and a retaining opening, wherein the clamping spring has a first free end and a second free end, and the clamping spring is fixedly restrained at the first free end in the retaining opening on the contact frame, wherein, at its second free end, the clamping spring is divided into a number of finger projections which corresponds to the number of plug openings by means of one or more slot cutouts and wherein each of the projections is passed through in each case one of the plug openings and a conductor can be clamped tightly in each of the plug openings by in each case one of the projections, and wherein an adjustment contact part is integrally formed on the contact frame, such that an acute angle is formed with each finger projection of the clamping spring and a funnel-shaped opening is realized.

2. The spring force terminal according to claim 1, wherein the contact frame has two plug openings and a retaining opening (13), wherein the clamping spring is fixedly restrained at the first free end in the retaining opening on the contact frame, wherein, at its second free end, the clamping spring is divided into two finger projections by means of a slot cutout, and wherein each of the two projections is passed through in each case one of the plug openings and a conductor can be clamped tightly in each of the two plug openings by in each case one of the projections.

3. The spring force terminal according to claim 1, wherein the contact frame has a rectangular outer contour.

4. The spring force terminal according to claim 1, wherein the plug openings and the retaining opening are rectangular.

5. The spring force terminal according to claim 1, wherein one free end of the contact frame is connecting part for fixing an electrical outgoing conductor and is oriented in an insertion direction of the conductor.

6. The spring force terminal according to claim 1, wherein the adjustment contact part is a bent metal sheet which is integrally formed on an end of the contact frame which lies opposite the connecting part.

7. The spring force terminal according to claim 1, wherein the contact frame is divided into the plug openings and the retaining opening by means of webs.

8. The spring force terminal according to claim 7, wherein one of the webs is a means for protecting the spring projections from being overextended.

9. The spring force terminal according to claim 8, wherein said webs include two webs arranged in the contact frame as a transverse web and a longitudinal web in a T configuration so as to produce two plug openings and a retaining opening.

10. The spring force terminal according to claim 9, wherein the retaining opening is arranged above the transverse web, and the plug openings are arranged below the transverse web and on both sides of the longitudinal web in the contact frame such that the transverse web acts as a means for protecting the spring projections from being overextended.

11. The spring force terminal according to claim 1, wherein the clamping spring is bent into a U shape.

12. The spring force terminal according to claim 11, wherein the clamping spring is provided with a slot in the longitudinal direction on a subsection starting from a branch of the spring projections in a direction of the first free end of said clamping spring.

13. A service switching device having at least one spring force terminal according to claim 1, wherein a terminal housing is integrated into a housing of the switching device.

14. The service switching device according to claim 13, wherein the at least one spring force terminal is held in a region of the service switching device located inside a housing shell that accommodates the at least one spring force terminal.

* * * * *